US006679814B2

(12) United States Patent
Chung-Ting

(10) Patent No.: US 6,679,814 B2
(45) Date of Patent: Jan. 20, 2004

(54) ROWER EXERCISER

(76) Inventor: Tseng Chung-Ting, P.O. Box 24-108, Taipei (TW)

( * ) Notice: Subject to any disclaimer, the term of this patent is extended or adjusted under 35 U.S.C. 154(b) by 0 days.

(21) Appl. No.: 10/075,077

(22) Filed: Feb. 13, 2002

(65) Prior Publication Data

US 2003/0153437 A1 Aug. 14, 2003

(51) Int. Cl.[7] ..... A63B 69/06
(52) U.S. Cl. ..... 482/72
(58) Field of Search ..... 482/72–73, 112–113, 482/908

(56) References Cited

U.S. PATENT DOCUMENTS 457,602 A * 8/1891 Coop ..... 482/73
4,621,623 A * 11/1986 Wang ..... 482/73
4,722,520 A * 2/1988 Lee ..... 482/73
4,768,775 A * 9/1988 Marshall ..... 482/73
4,795,147 A * 1/1989 Seal ..... 482/73

* cited by examiner

*Primary Examiner*—Stephen R. Crow
(74) *Attorney, Agent, or Firm*—Troxell Law Office PLLC

(57) ABSTRACT

A rower exerciser includes a frame which is disposed on the floor to serve as a supporting frame, a slide rail connected between front end rear ends of the frame, and a slide seat slidably mounted on the rail to slidably reciprocate along the rail and being adapted for sitting by the user. Two sides of a front end of the slide rail are respectively connected to outwardly extending curved arm frames. Each of the arm frames is connected pivotally to a rocker via a universal connector. The rocker and a respective one of the arm frames are connected pivotally to a hydraulic rod via a pivot seat. By adjusting the foot pedals and the slide seat to be in a fixed mode or a slidable mode, and by virtue of the universal connector and the pivot seat, the rockers can rotatably swing to enable the user to simulate actual rowing actions and to provide various exercising effects.

3 Claims, 3 Drawing Sheets

ROWER EXERCISER

BACKGROUND OF THE INVENTION (a) Field of the Invention

The invention relates to a rower exerciser, more particularly to a rower exerciser that is directed to improving conventional rower exerciser that permits only back and forth pulling and pushing movements, which do not resemble actual rowing actions, and that does not permit much adjustment. The rower exerciser of this invention includes a frame which is disposed on the floor to serve as a supporting frame, a slide rail connected between front end rear ends of the frame, and a slide seat slidably mounted on the rail to slidably reciprocate along the rail and being adapted for sitting by the user. Two sides of a front end of the slide rail are respectively connected to outwardly extending curved arm frames. Each of the arm frames is connected pivotally to a rocker via a universal connector. The rocker and a respective one of the arm frames are connected pivotally to a hydraulic rod via a pivot seat. By adjusting the foot pedals and the slide seat to be in a fixed mode or a slidable mode, and by virtue of the universal connector and the pivot seat, the rockers can rotatably swing to enable the user to simulate actual rowing actions and to provide various exercising effects.

(b) Description of the Prior Art

With the rise in living standards, exercising apparatuses have become quite popular. Conventional rower exercisers mainly permit back and forth movements to achieve the object of exercising. However, such back and forth rowing actions do not resemble actual rowing actions that include outward and swinging actions in cooperation with back and forth reciprocating movements. Besides, the conventional rower exercisers do not permit different adjustments, which may make the user feel bored after a long period of use. Improvements are therefore desirable.

SUMMARY OF THE INVENTION

The primary object of the invention is to provide a rower exerciser that has a boat-shaped frame adapted to be placed on the floor. A slide rail is connected between front end rear ends of the frame, and a slide seat is slidably mounted on the rail to slidably reciprocate along the rail or to be fixed thereon. Two sides of a front end of the slide rail are respectively connected to outwardly extending curved arm frames. Each of the arm frames is connected pivotally to a rocker via a universal connector. The rocker and a respective one of the arm frames are connected pivotally to an adjustable hydraulic rod via a pivot seat. By virtue of the universal connector and the pivot seat, the rockers can swing to simulate actual rowing actions.

Another object of the invention is to provide a rower exerciser which further includes foot pedals mounted at the front end of the frame to drive a pneumatic rod to displace. By adjusting the foot pedals and the slide seat to be in a fixed mode or a slidable mode, and in conjunction with the adjustable hydraulic rod, the rower exerciser can provide different adjustments to suit different users and to provide various extents of exercising in a long training drill.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
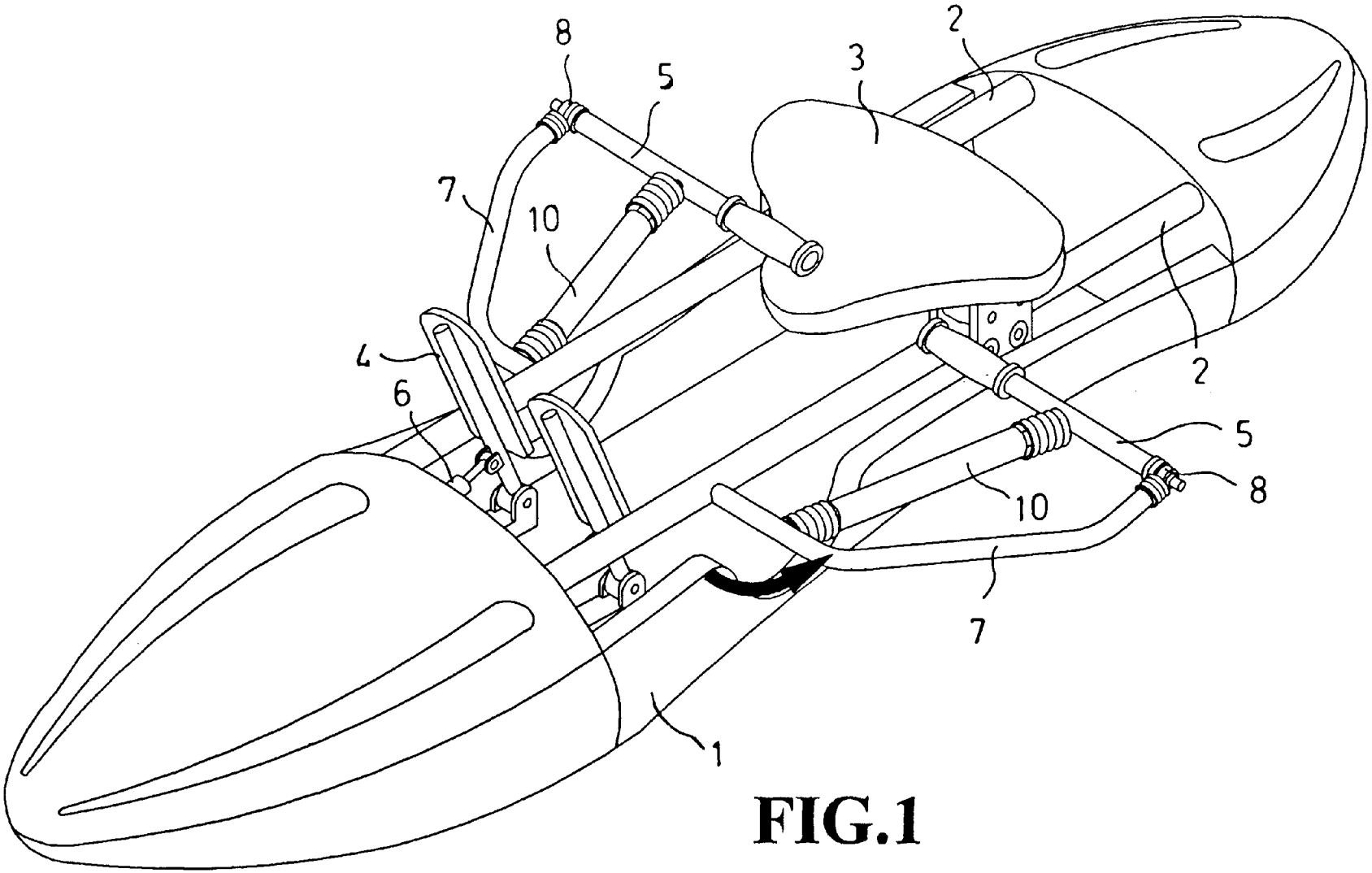
FIG. 1 is a perspective view of the embodiment of the invention.
Figure 2:
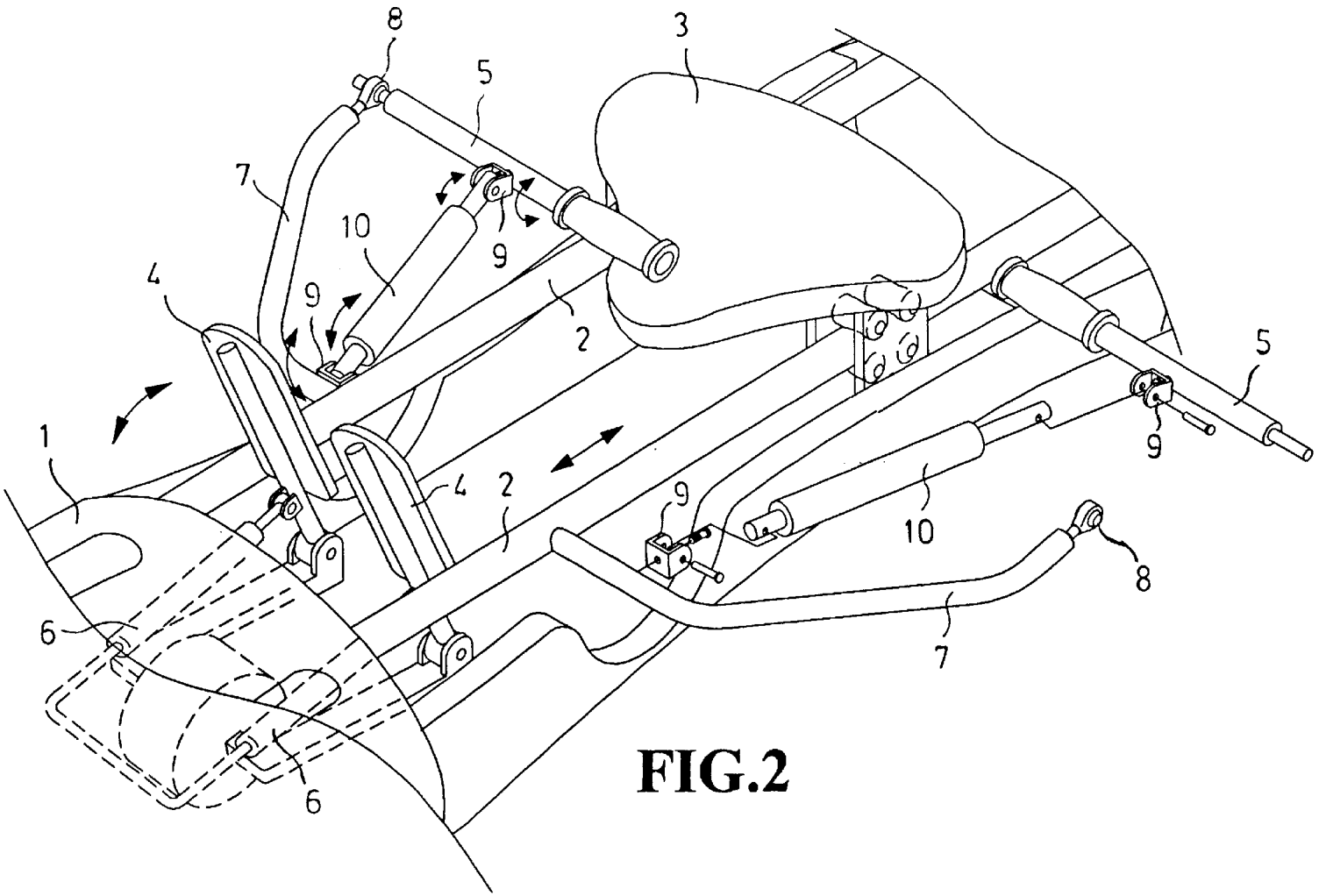
FIG. 2 is an exploded perspective view of the embodiment of the invention.
Figure 3:
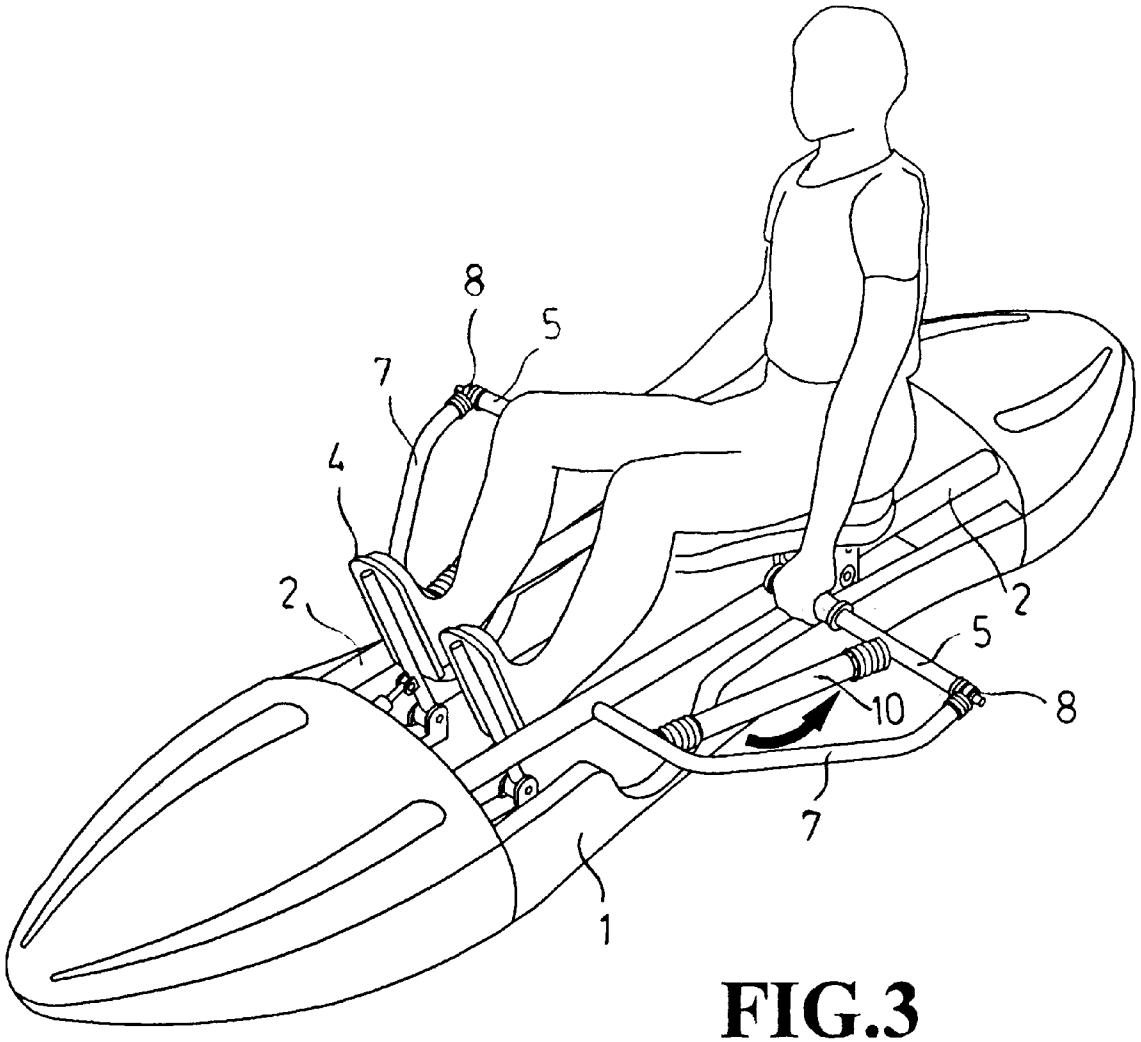
FIG. 3 is a perspective view of the embodiment of the invention in a state of use.

With reference to FIGS. 1 to 3, the present invention mainly includes a frame 1, a slide rail 2, a slide seat 3, foot pedals 4, rockers 5. The frame 1 is a supporting frame adapted to be place on the floor. In the embodiment as shown in the drawings, the front and rear portions of the frame are configured to resemble front and rear parts of a boat. The foot pedals 4 are mounted at a front end for pedaling and to drive a pneumatic rod 6 to displace. The slide rail 2 is connected between the front and the rear ends of the frame 1. The slide rail 2 may be a single rail, a double rail or a multi-rail type. The slide seat 3 is slidably mounted on the slide rail 2, and can slidably reciprocate therealong or can be secured in position to serve as a seat for the user. Two sides of a front end of the slide rail 2 are respectively secured to outwardly extending curved arm frames 7. Each of the arm frames 7 has as distal end connected pivotally to a respective one of the rockers 5 via a universal connector 8. An adjustable hydraulic rod 10 is pivotally mounted between the rocker 5 and the arm frame 7 by means of a pivot seat 9.

In actual use, the user can adjust the pulling force of the hydraulic rod 10 according to the forces of his arms or the extent of exercise desirable. The user can then sit on the slide seat 3 and grips the end portions of the rockers 5 with both hands as if they were paddles. The rockers 5 use the universal connector 8 as a pivot point and rotatably swing. At the same time, the hydraulic rod 10 is pulled and compressed. The hydraulic rod 10 can freely rotate about the pivot seat 9 to produce a relative smooth application of force, thereby achieving an exercising effect that simulates actual rowing. In addition, the foot pedals 4 and slide seat 3 can be selectively adjusted to be in a fixed mode or a slidable mode to permit different swinging and exercising choices within a different space to suit different users or to permit various extents of exercising in a relatively long training drill to thereby increase variety and avoid monotony.

Although the present invention has been illustrated and described with reference to the preferred embodiment thereof, it should be understood that it is in no way limited to the details of such embodiment but is capable of numerous modifications within the scope of the appended claims.

What is claimed is:

1. A rower exerciser comprising:

a) a frame;

b) a pair of slide rail mounted between a front and a rear of the frame;

c) a slide seat mounted on the slide rails, such that the slide seat is selectively fixed to the slide rails or the slide seat reciprocally slides along a length of the slide rails;

d) two curved arm frames, a first end of each curved arm frame fixedly connected to and extending outwardly from lateral sides of said respective slide rails;

e) two rockers, a first end of each rocker pivotally connected to a second end of one of the two curved arm frames;

f) two hydraulic rods, one hydraulic rod pivotally connected between each curved arm frame and each rocker on lateral sides of said resspective slide rails; and g) a pair of foot pedals connected to the front of the frame, each foot pedal pivotally connected to a pneumatic rod, such that the foot pedals are selectively adjustable so as to be either fixed or pivotal relative to the front of the frame.

2. The rower exerciser according to claim 1, wherein the two hydraulic rods are adjustable.

3. The rower exerciser according to claim 1, wherein the front and the rear of the frame are shaped like a boat.

* * * * *